US012486726B2

(12) United States Patent
Kolstad et al.

(10) Patent No.: US 12,486,726 B2
(45) Date of Patent: Dec. 2, 2025

(54) COILED TUBING

(71) Applicant: COILCOM AS, Sandnes (NO)

(72) Inventors: Borge Richard Kolstad, Stavanger (NO); Bjorn Brekne, Hafrsfjord (NO)

(73) Assignee: COILCOM AS, Sandnes (NO)

( * ) Notice: Subject to any disclaimer, the term of this patent is extended or adjusted under 35 U.S.C. 154(b) by 0 days.

(21) Appl. No.: 18/256,911

(22) PCT Filed: Dec. 9, 2021

(86) PCT No.: PCT/NO2021/050257

§ 371 (c)(1),
(2) Date: Jun. 9, 2023

(87) PCT Pub. No.: WO2022/124910

PCT Pub. Date: Jun. 16, 2022

(65) Prior Publication Data

US 2024/0093558 A1 Mar. 21, 2024

(30) Foreign Application Priority Data

Dec. 9, 2020 (NO) ..... 20201349

(51) Int. Cl.
*E21B 17/20* (2006.01)
*E21B 36/04* (2006.01)

(52) U.S. Cl.
CPC ..... *E21B 17/206* (2013.01); *E21B 36/04* (2013.01)

(58) Field of Classification Search
CPC ... E21B 17/206; E21B 36/04; B29K 2105/12; B29C 63/34
See application file for complete search history.

(56) References Cited

U.S. PATENT DOCUMENTS

| | | | | |
|---|---|---|---|---|
| 6,863,137 | B2 * | 3/2005 | Terry | G01V 3/30 175/320 |
| 8,662,160 | B2 | 3/2014 | Dewitt et al. | |
| 10,844,673 | B2 * | 11/2020 | Melo | E21B 19/22 |
| 2002/0007945 | A1 | 1/2002 | Neuroth | |
| 2011/0024103 | A1 | 2/2011 | Storm, Jr. | |
| 2012/0155813 | A1 | 6/2012 | Quigley | |

FOREIGN PATENT DOCUMENTS

| | | | | |
|---|---|---|---|---|
| CA | 2645630 | A1 * | 5/2009 | E21B 17/206 |

* cited by examiner

*Primary Examiner* — D. Andrews
(74) *Attorney, Agent, or Firm* — NEXUS LAW PLLC

(57) ABSTRACT

A length of tubing and related apparatus and methods are described, where the length of tubing is deployable from a coiled configuration to an uncoiled configuration for performing a coiled tubing operation in a wellbore. The length of tubing includes a pipe of metal, and a liner of composite material that lines the pipe. The liner or the lined pipe includes a wall structure that incorporates means to communicate at least one service along the tubing.

14 Claims, 3 Drawing Sheets

COILED TUBING

CROSS REFERENCE TO RELATED APPLICATIONS

The present application claims the priority benefits of International Patent Application No. PCT/NO2021/050257, filed on Dec. 9, 2021, and claims benefit of NO 20201349, filed on Dec. 9, 2020, which are hereby incorporated herein by reference in their entireties.

FIELD OF THE INVENTION

The present invention relates in particular to coiled tubing.

BACKGROUND OF THE INVENTION

In the oil and gas exploration and production industry, coiled tubing is from time to time deployed in a well for example to perform a workover or well intervention operation or otherwise service the well.

Traditional coiled tubing comprises flexible pipe which is wound on a reel at surface. A tool for performing the operation in the well is typically disposed on the downhole end of the coiled tubing. The tubing therefore provides a conveyance means for running the tool into the desired position in the well. In addition, fluid may be communicated, or a device may be deployed or retrieved, through an inside of the coiled tubing.

The flexible pipe of traditional coiled tubing comprises a wall structure of steel, which generally is well suited to withstand the physical demands of use in the wellbore, e.g. mechanical wear and tear and chemical conditions, provide appropriate weight to strength ratio and provide suitable stiffness and/or strength to urge the tubing from surface equipment, e.g., on rig or vessel, into the well. The coiled tubing is designed to resist and withstand lateral forces, e.g., resisting collapse when on the reel or in the well, circumferential twisting forces, and axial forces.

In some cases, fluids that may (or may not) carry solid particles such as proppants are transmitted through the inside of the coiled tubing and delivered through appropriate tooling into a formation. The fluids may be required in large volumes. Proppants may typically be used in wellbore fracking operations.

Well service operations have in the past been performed with an electric cable deployed inside the coiled tubing. In these operations the diameter of the coiled tubing is typically from 1.5" to 3.25". The electric cable extends along the inside of the tubing, and can allow power and/or data to be communicated between the tool on the end of the tubing and the surface. As structural forces are accommodated by the flexible metal walling, the electric cable is not required to carry such significant loads. The electrical cable may therefore conveniently reside "loosely" within the bore of the tubing.

Demands have increased for obtaining data from well service operations and such data may for example include temperature and pressure and flow from downhole sensors. Data may thus be obtained and communicated through the electric cable of the tubing while performing the coiled tubing operation in the well.

The inventors have noted that these operations can suffer electric disconnect and/or data failure as the electric cable may not provide a robust link along the tubing. In a pumping operation, the cable and internal wall of the tubing is exposed to the fluid and various forces imparted to it by pumping the fluid. Furthermore, fluids to be pumped can have different chemical effects, e.g., acid or saline, and may carry particles e.g., for proppant action. As a result, the electric cable may suffer strain, wear, and fatigue from the effects of the fluid. In some cases, the fluid may be turbulent affecting the cable and the internal wall of the coiled tubing accordingly, and as a result the pumping operation may need to be stopped or paused to tighten up the cable.

There is a need for improved provision of electric power and/or data links for such well service operations, in particular for operations which call for fluids of various kinds to be pumped and delivered into the well along the coiled tubing.

SUMMARY OF THE INVENTION

At least one aim of the invention is to obviate or at least mitigate one or more draw-backs associated with prior art.

According to a first aspect of the invention, there is provided a length of tubing which is deployable from a coiled configuration to an uncoiled configuration for performing a coiled tubing operation in a wellbore, the length of tubing comprising: a pipe of metal; and a liner of composite material that lines the pipe, the liner or the lined pipe comprising a wall structure that incorporates means to communicate at least one service along the tubing.

The liner with the means incorporated to communicate the service is disposed on an inside of the pipe of metal. Thus, it may line an inside of the pipe. The means to communicate the service along the tubing is typically embedded in the composite liner, and may for example be an elongate member such as a conductor in the form of a wire or the like. In other examples, the elongate member may be an optical fiber. The liner typically comprises a tubular liner or line pipe adapted for close fit within the pipe of metal, and the means to communicate the service along the tubing is also typically arranged within the material of the wall of the liner pipe.

The communicated service typically comprises any one or more of: electric power; data; and control fluid.

The means incorporated to communicate the service along the tubing may comprise an elongate member or structure selected from any one or more of: an electrical conductor; an optical fiber; a fluid channel.

The metal may comprise or consist essentially of steel. The steel may be stainless steel, or duplex steel. In the example of steel, the tubing may have favorable durability, flexibility, and strength properties. Internal corrosion resistance in the wellbore environment may be facilitated by the composite. Other metals or alloys having a similar performance to steel may alternatively be used.

The composite material may comprise fibers combined with one or more polymers. The polymer may be adapted to withstand temperatures in the wellbore of up to around 200 degrees Celsius. The composite material may comprise a thermoplastic polymer. The thermoplastic polymer may comprise a polyketone, e.g., a semicrystalline aromatic polyketone, e.g. polyetheretherketone PEEK and/or PAEK or PEKK. The polymer may comprise a polyphenylenesulphide, such as polyethylene sulphide PPS. The polymer may comprise a fluorinated thermoplastic such as perfluoroalkoxy PFA or PVDF. Selection of the polymer can be based upon the expected operational conditions, e.g., pressure, temperature in the well.

The composite material may comprise fibres selected from any of glass fibers, aramid fibers, carbon fibers, UHMWPE fiber, LCP fibers, and steel fibers, or any combinations thereof.

The liner of composite material may comprise fibers combined with polymer by any of pullwinding; pultrusion; and filament winding or any combination of these. The means incorporated to provide the service along the tubing may comprise at least one elongate member, e.g. an electrical conductor [e.g. a thin elongate conductor such as a wire] or an optical fiber, or the like, for incorporation into the material of the composite liner, and can provide a convenient way of providing the means for communicating data or power etc. along the coiled tubing for operations in the wellbore.

The elongate member may be guided to be placed in the middle of the material of the wall of the liner, e.g., in a pultrusion sequence of the manufacturing process.

The elongate member, e.g., a conductor such as an insulated wire or e.g., an optical fiber, may be incorporated, e.g. woven, into the wall structure of the liner as part of a filament winding process. The elongate member may be wound together with fiber threads or filaments, e.g., together with carbon threads or filaments, for incorporation of the elongate member into the material of the liner.

The liner may be pre-produced with the elongate member or other means to communicate the service along the tubing incorporated in the wall structure of composite material of the liner. The liner together with the elongate member or said other means may then be inserted into the pipe e.g., retrofitted to a length of the pipe of metal. Advantageously, the composite material can protect the elongate member from exposure to the interior, i.e., the main bore, of the length of tubing. The interior of the length of tubing, e.g. the main bore of the tubing, may thus be employed in use (full bore) for transmitting fluids, e.g. proppants or the like, through the tubing and into the wellbore in a coiled tubing operation, e.g. a well service operation, whilst the elongate member or means incorporated in the wall structure of the liner can be used to communicate a service separate from the main bore e.g. to communicate, control, or convey information to or from downhole tools, sensors, instruments, or equipment.

The elongate member or means incorporated in the wall structure may take a spiral trajectory or an axial parallel trajectory along the tubing. In the spiral trajectory, the elongate communication member may be wound conveniently together in pattern with the fibers of the composite.

The elongate member or means incorporated in the wall structure may take various forms. For example, the elongate member may comprise any one or more of: an electrical conductor for communicating signals, data, and/or power along the tubing; an optical fiber for communicating optical signals and/or data along the tubing; an optical sensing fiber for sensing a condition in the tubing and/or communicating data and/or signals along the tubing; a tube or conduit for communicating control fluid along the tubing; heating cable, e.g. for heating a production fluid flowing through an inside, e.g. main bore, of the tubing. The heating cable may facilitate in well work and/or as part of flowlines for subsea petroleum production typically in deep waters to avoid wax, hydrates and other low temperature issues. To assist in the latter, the means incorporated to communicate the service along the tubing may comprise an electrical conductor which may comprise at least one section of resistance wire for producing heat upon passage of current through the section. The heat may thus transfer to and elevate the temperature the inside, e.g., the main bore, of the tubing.

In the case of being an electrical conductor, the conductor may comprise an insulated cable or wire. Power may be delivered through the electrical conductor to a tool supported on the tubing. In the case of one or more sensors being disposed on the coiled tubing, e.g., to measure downhole temperature, pressure, or flow, the electrical conductor may be utilized to transmit data or signals along the conductor, between the sensor downhole in the wellbore and surface.

In the example of being an optical sensing fiber, the optical sensing fiber may be configured to perform distributed sensing along the fiber, e.g. for measuring temperature, pressure, or flow along the tubing.

Signals may be provided through the elongate member, or other means incorporated to communicate the service along the tubing, to control or initiate instruments, sensors, and/or tools on the tubing. Data may be communicated through the elongate member or the other means incorporated to communicate the service along the tubing. Such data may comprise any one or more of: depth and/or position data; geological structure data; well logging data, e.g., data obtained from logging while drilling and/or in production.

The liner may be fitted to the pipe to have an outer surface of the liner in friction contact with an inside of the pipe. The pipe of metal may be an outer pipe and the liner is an inner pipe within the outer pipe. The elongate member or the other means for communicating the service along the tubing may then be incorporated in the material of the wall structure of the inner pipe. Accordingly, the pipe may have a pipe-in-pipe configuration, and the length of pipe may preferably be a two-part pipe.

According to a second aspect of the invention, there is provided a method of producing a length of coiled tubing in accordance with the first aspect of the invention, the method comprising the steps of: providing the pipe of metal; and lining an inside of the pipe with a liner of composite material, the wall structure of the liner or the lined pipe incorporating means to communicate the service along the tubing.

The method may further comprise producing the liner. The liner may be produced by combining fibers and polymer in one or more steps of pultrusion, filament winding, or pull winding. The incorporated means to communicate the service along the tubing may comprise at least one elongate member, and the method may include guiding the elongate member into a wall structure of the liner. The method may include performing at least one pultrusion, filament winding, or pull winding process or sequence, and the elongate member may be guided into the wall structure, e.g., into a middle of the material of the wall of the liner, e.g. in that process or sequence, e.g. whilst simultaneously winding fibers or filaments for producing the wall structure.

The pipe of metal may be lined by inserting the liner into the pipe. The liner may be inserted by applying pressure inside the liner against a closed end surface to drive the liner into the pipe.

According to a third aspect of the invention, there is provided a method of performing a coiled tubing operation in a wellbore: supporting a tool on an end of a length of tubing according to the first aspect of the invention; uncoiling the length of tubing from the drum into the well to deploy the tool in the wellbore; performing the operation using the tool; and communicating power, data and/or signals along the coiled tubing through the means incorporated in the material of the wall structure of the liner.

According to a fourth aspect of the invention, there is provided a length of tubing which is deployable from a coiled configuration to an uncoiled configuration for performing a coiled tubing operation in a wellbore, the length of tubing comprising a wall structure comprising means for communicating at least one service along the tubing. The length of tubing may comprise a pipe, e.g., a pipe of metal, and a liner, e.g., a liner of composite material, that lines the pipe, e.g. lines an inside of the pipe. The liner or the lined pipe may comprise a wall structure that incorporates means to communicate the at least one service along the tubing. The pipe may consist essentially of or comprise metal. The liner may consist essentially of or comprise composite material. The means for communicating the service may be a member or structure incorporated in the wall structure, for example may be a thin, elongate member such as any of: an electrical conductor, e.g., wire or cable; an optical fiber; and/or small-diameter fluid conduit or channel. The elongate member may preferably have an outer diameter that is less than the wall thickness of the liner or lined pipe so as to permit incorporation within the thickness extent of the wall structure of the liner or the lined pipe.

According to a fifth aspect of the invention, there is provided a method of producing a length of coiled tubing in accordance with the fourth aspect of the invention.

According to a sixth aspect of the invention, there is provided a method of performing a coiled tubing operation in a wellbore: supporting a tool on an end of a length of tubing according to the first or fourth aspects of the invention; uncoiling the length of tubing from the drum into the well to deploy the tool in the wellbore; performing the operation using the tool; and communicating power, data and/or signals along the coiled tubing in the wall structure.

According to a seventh aspect of the invention, there is provided coiled tubing comprising the length of tubing in accordance with the first or seventh aspects of the invention.

According to an eighth aspect of the invention, there is provided a coiled tubing reel comprising the coiled tubing in accordance with the seventh aspect of the invention. According to a ninth aspect of the invention, there is provided a liner for the length of tubing according to the first or fourth aspects of the invention.

Any of the various aspects of the invention may have one or more further features as described in relation to any other aspect wherever described herein.

These and other objects, advantages and features of the invention will become apparent upon review of the following specification in conjunction with the drawings.

BRIEF DESCRIPTION OF THE DRAWINGS

There will now be described, by way of example only, embodiments of the invention, with reference to the accompanying drawings, in which.

DESCRIPTION OF THE PREFERRED EMBODIMENTS

Figure 1:
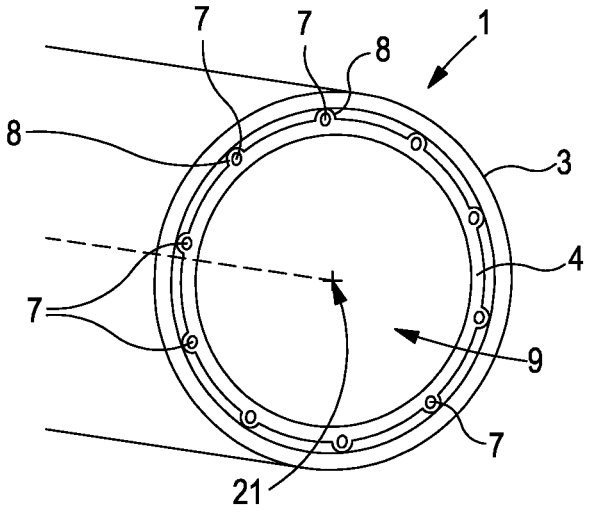
FIG. 1 is a perspective sectional view of a length of tubing according to an embodiment of the invention.

The length of tubing 1 in FIG. 1 has an outer pipe 3 of steel and an inner liner pipe 4 of composite material incorporating means in the form of elongate electrical conductors 7 for communicating power, data or signals along the tubing.

The tubing 1 has a central longitudinal axis 21. The electrical conductors 7 extend axially in parallel along the tubing 1. The electrical conductors are each associated with a radially protruding rib 8. The ribs 8 are in friction contact against an inside of the outer pipe 3. The liner pipe 4 is inserted into the outer pipe 3 in order to line the pipe to produce the lined tubing. The ribs 8 act to provide stand off from the inner surface of the pipe 3 so as to facilitate reduction of friction and provide space for escape of air upon inserting the liner into place.

In use, coiled tubing comprising the length of tubing of FIG. 1 can be employed in a wellbore with a tool on a far end of the tubing to perform an operation in the wellbore. The length of tubing is flexible and is deployed from coiled configuration on the reel to an uncoiled configuration where it is used in the wellbore. A work fluid for performing the operation can be transmitted through the bore 9 of the tubing 1 into the wellbore. Example work fluids include proppants or chemicals e.g., for treating the wellbore or formation.

Figure 2:
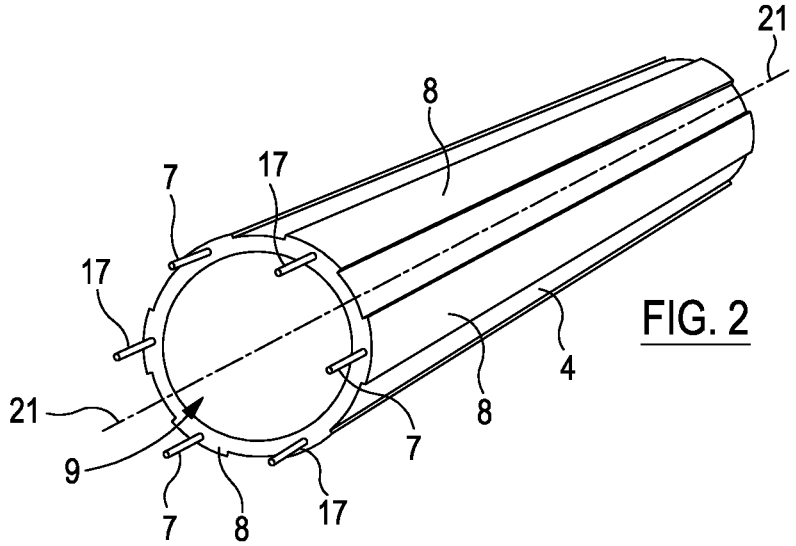
FIG. 2 is a perspective view of a liner for a length of tubing according to an embodiment of the invention.

In FIG. 2, an alternative liner pipe 4 is illustrated. The liner pipe of FIG. 2 can be fitted similarly to an outer pipe 3. In this case however, the liner pipe 4 has communication members in the form of three optical fibers 17 for data transmission along the tubing and three electrical conductors 7 for transmitting electrical power along the tubing. The ribs 8 are wider and fewer than in FIG. 1.

Figure 3:
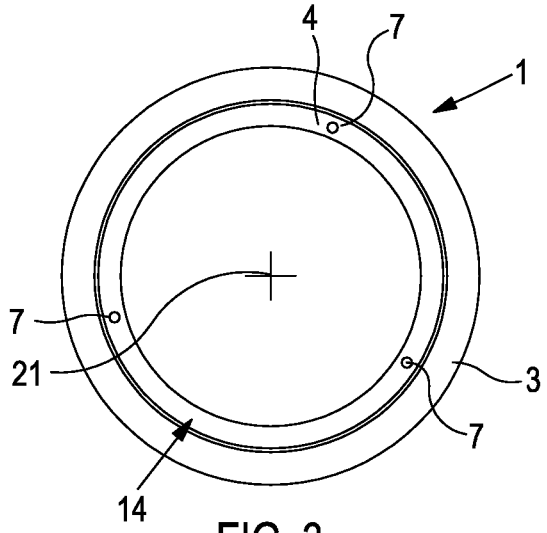
FIG. 3 is a sectional view of the length of tubing perpendicular to the longitudinal direction according to an embodiment of the invention.

In FIG. 3, an alternative tubing 1 is depicted. The liner pipe 4 in this example does not have ribs, but the liner pipe is dimensioned relative to the outer pipe 3 to provide clearance 14 between the outer surface of the liner pipe 4 and the inner surface of the outer pipe 3, sufficient to allow insertion without succumbing to friction effects. Three conductors 7 are provided and incorporated into the material of the liner pipe.

Figure 4:
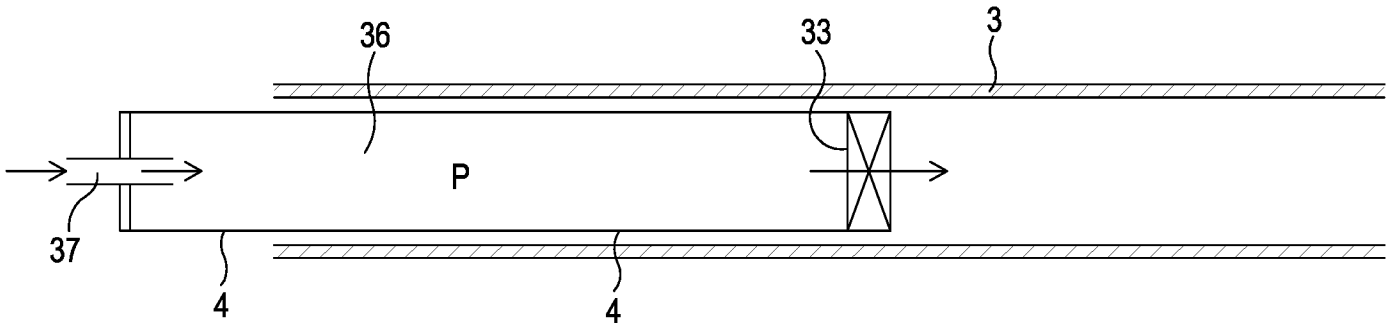
FIG. 4 is a schematic representation of a step of a method of producing the tubing.
Figure 5:
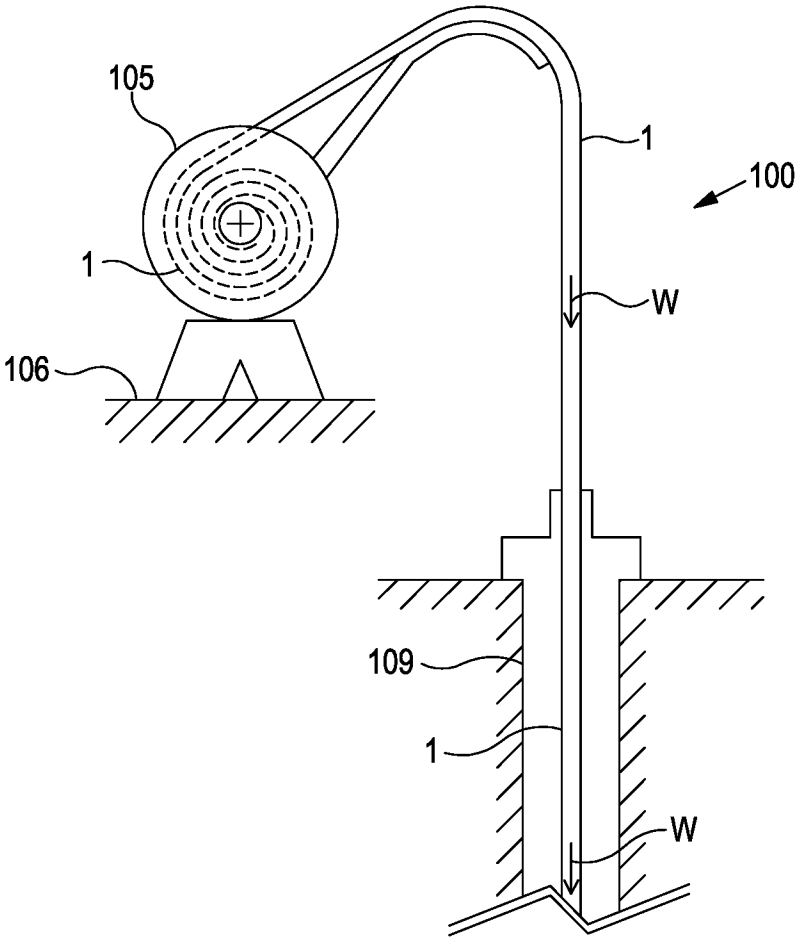
FIG. 5 is a schematic representation of performing an operation in the wellbore using the tubing.

The liner pipe 4 can be inserted into the outer pipe 3 as indicated in FIG. 4. An end of the liner pipe 4 is closed off by closure member 33. The liner pipe, closed end first, is inserted into the outer pipe 3. The interior 36 of the inner pipe is pressurized by delivering a pressurized fluid through inlet 37 at the opposite end. The pressure in the interior 36 acts against a surface of the closure member and drives the liner pipe 4 into the outer pipe to thereby form the lined tubing 1.

In use, apparatus 100 is generally depicted where coiled tubing 1 is uncoiled from a reel 105 that is located topsides at surface 106, e.g., a rig. The tubing 1 is being used in a wellbore 109 for performing a downhole operation in the wellbore. Sensors (not shown) are provided on the coiled tubing 1 in the wellbore. Data from the sensors are communicated up through the coiled tubing 1 to surface through the communication means, e.g., conductor or optical fiber, in the material of the wall structure of the liner pipe of the tubing. Thus, data can be obtained during wellbore operations. Work fluid can be transmitted through the interior of the tubing 1 and delivered into the wellbore in the wellbore operation as indicated by arrow W.

Operational temperatures in the well are typically up to 150 to 170 degrees Celsius. The coiled tubing is subjected to tough chemical conditions. Materials are selected and the coiled tubing constructed accordingly. The outer pipe is in this case is a flexible pipe of steel.

The composite material of the liner is a combination of polymer and fibers, and the polymer can be for instance a thermoplastic polymer such as one of polyetheretherketone PEEK, polyethylene sulphide PPS, and perfluoroalkoxy PFA. PVDF is an alternative for lower temperatures below 140 degrees Celsius. PEEK can be advantageous in the well in that it has low water absorption, and can cope well with chemicals such as ammonia gas, carbon monoxide gas, ethylene glycol (50%), hydrogen sulphide gas, methane, phosphoric acid (50%), sodium hydroxide solution, and sulphur dioxide gas. PPS can be advantageous in that it can have very high resistance to thermal degradation and chemical reactivity and low moisture absorption under high heat and humidity conditions. It can cope well with methane, carbon dioxide, hydrogen sulphide, hydrogen gas, nitrogen, potassium chloride, sulphur dioxide, salt water/seawater. PFA resins may be advantageous in good chemical and thermal stability.

The composite fibers can be selected suitably for reinforcement of the tube for facilitating circumferential, axial and radial strength to withstand high operating pressures and tensile and compression stresses. The fibers can be provided in fiber reinforced UD tapes with carbon or glass fibers. The form of fiber reinforcement can be decided as appropriate for the processing technique for producing the tubing.

The liner pipe of composite material can suitably be produced by pull winding. The conductors, e.g., wires, are incorporated in the wall of the liner pipe by appropriate placement of the conductor in the course of the manufacturing process. A monitored process is employed, where the wire/conductor is guided into the center of the wall at the appropriate stage, e.g., after an inner portion of the wall has been formed and before an outer portion of the wall is formed. Visible light and/or x-ray illumination of the liner pipe under manufacture is used to control the process and ensure proper placement of the conductor, preferably embedded centrally in the wall material of the composite liner pipe. The conductor can be positioned in desired position within a tolerance in the range of 0.3 mm to 0.5 mm. The ribs 8 of the external structure of the tubing are produced by the die and/or mold in the pull winding process. The die/mold gives the desired design, shape and structure which can be predefined as required.

The technique can provide significant benefits as data can be collected and retrieved in real time and throughout operations being carried out in the wellbore. The provision of the communication member in the material of the wall of the tubing can provide a robust positioning for the communication member, where it may not be susceptible to the effects of work fluid transmitted through the tubing. Thus, risks of damage, wear, and pauses in operations can be avoided or reduced. Provision of the liner, in effect in the form of a flexible sock that can be readily inserted and retrofitted to metal coiled tubing pipes. The outer pipe of steel can in itself be comparable in performance of flexure, strength, integrity etc. to traditional steel coiled tubing, although the performance is enhanced in the present concept by the provision in addition of the liner pipe.

Various modifications and improvements may be made without departing from the scope of the invention herein described. For example, in some variants an electrical conductor may instead be an optical fiber for data communication and/or sensing conditions in the tubing. A fluid conduit may be provided in place of an electrical conductor for conveying control fluid along the tubing e.g., for controlling a downhole valve or the like.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A method of producing a length of tubing to be used as a coiled tubing in a wellbore, the method comprising:

providing a pipe of metal to be used as an outer pipe having an outer surface and an inner surface;

providing at least one elongate member to communicate or deliver at least one service along the coiled tubing in use;

producing a liner for insertion into and lining an inside of the outer pipe, the liner having an outer surface and an inner surface, the liner being configured to provide, when inserted into the outer pipe, a clearance between the outer surface of the liner and the inner surface of the outer pipe, wherein the liner is formed as a composite material having fibers combined with a polymer by a pultrusion, filament winding, or pull-winding process, wherein the pultrusion, filament winding, or pull-winding process to form the liner comprises the steps of:

forming a wall structure of the liner of composite material;

winding the at least one elongate member together with fiber threads or filaments;

incorporating the elongate member into the wall structure; and guiding the at least one elongate member into the wall structure of the liner after an inner portion of the wall structure is formed and before an outer portion of the wall structure is formed;

retrofit inserting the produced liner of composite material into the outer pipe to line the inside of the outer pipe with the liner of composite material having the at least one elongate member incorporated therein;

wherein the liner is inserted into the outer pipe by one end of the liner having a closure member and by applying pressure inside the liner to drive the liner into the outer pipe; and wherein the outer surface of the liner inserted into the outer pipe is in friction contact with the inner surface of the outer pipe.

2. The method of claim 1, wherein the at least one elongate member for communicating or delivering the service along the tubing and which is guided into the wall structure comprises an electrical conductor, an optical fiber, or a fluid channel.

3. A length of coiled tubing for performing a coiled tubing operation in a wellbore, the coiled tubing comprising:

an outer pipe of metal having an outer surface and an inner surface;

at least one elongate member for communicating or delivering at least one service along the coiled tubing; and a liner for insertion into and lining an inside of the outer pipe and having an outer surface and an inner surface, the liner is configured to provide, when inserted into the outer pipe, a clearance between the outer surface of the liner and the inner surface of the outer pipe, wherein the liner is formed as a composite material having fibers combined with a polymer via a pultrusion, filament winding, or pull-winding process, and wherein the liner is configured to include the at least one elongate member incorporated therein;

wherein the liner having the at least one elongate member incorporated therein includes a wall structure having the at least one elongate member wound together with fiber threads or filaments and guided into the wall structure of the liner after an inner portion of the wall structure is formed and before an outer portion of the wall structure is formed.

4. The length of coiled tubing of claim 3, wherein the at least one elongate member for communicating or delivering at least one service along the coiled tubing includes at least one of an electrical conductor, optical fiber, and fluid channel.

5. The length of coiled tubing of claim 4, wherein the at least one service along the coiled tubing includes at least one of electric power, data, and control fluid.

6. The length of coiled tubing of claim 3, wherein the at least one elongate member includes a plurality of electrical conductors, optical fibers, or a combination thereof, and wherein the electrical conductors or optical fibers extend axially in parallel along the outer pipe.

7. The length of coiled tubing of claim 6, wherein the outer surface of the liner includes a plurality of radially protruding ribs that are parallel to one another and each is in friction contact with the inner surface of the outer pipe.

8. The length of coiled tubing of claim 7, wherein each of the plurality of radially protruding ribs includes respective one of the electrical conductors or optical fibers.

9. The length of coiled tubing of claim 8, wherein the plurality of ribs is produced using a die or a mold during the pull-winding process.

10. The length of coiled tubing of claim 3, wherein the composite material of the liner is a combination of a thermoplastic polymer and fibers, and wherein the thermoplastic polymer is selected from the group consisting of a polyether ether ketone (PEEK), polyphenylene sulfide (PPS), perfluoroalkoxy (PFA), and polyvinylidene fluoride (PVDF).

11. A method of performing a coiled tubing operation in a wellbore, the method comprising:

providing a length of coiled tubing;

supporting a tool on an end of the coiled tubing;

uncoiling the coiled tubing from a drum into a well to deploy the tool in the wellbore;

using the tool to perform an operation, wherein the coiled tubing comprising:

an outer pipe of metal having an outer surface and an inner surface;

at least one elongate member for communicating or delivering at least one service along the coiled tubing; and a liner inserted into and lining an inside of the outer pipe and having an outer surface and an inner surface, the liner providing a clearance between the outer surface of the liner and the inner surface of the outer pipe, wherein the liner is formed as a composite material having fibers combined with a polymer via a pultrusion, filament winding, or pull-winding process, and wherein the liner includes the at least one elongate member incorporated therein;

wherein the liner having the at least one elongate member incorporated therein is produced by forming a wall structure of the liner, winding the at least one elongate member together with fiber threads or filaments, incorporating the at least one elongate member into the wall structure, and guiding the at least one elongate member into the wall structure of the liner after an inner portion of the wall structure is formed and before an outer portion of the wall structure is formed;

transmitting a work fluid through a central bore of the tubing and into the well for treating the wellbore; and communicating power, data or signals along the coiled tubing through the at least one elongate member incorporated in the wall structure of the liner.

12. The method of claim 11, wherein the performed operation comprises a well workover or well intervention operation.

13. The method of claim 11 further comprises transmitting a work fluid through a bore of the tubing and into the well for treating the wellbore.

14. The method of claim 13, wherein the work fluid comprises one or more proppants or chemicals.

* * * * *